US005891317A

United States Patent [19]

Teichmann et al.

[11] Patent Number: 5,891,317

[45] Date of Patent: Apr. 6, 1999

[54] ELECTROFORMED HOLLOW JEWELRY

[75] Inventors: Robert J. Teichmann, Towaco, N.J.; Dennis A. Cupolo, Suffern, N.Y.; Robert H. China; Harold Pahlck, both of Waldwick, N.J.

[73] Assignee: Avon Products, Inc., New York, N.Y.

[21] Appl. No.: 796,021

[22] Filed: Feb. 4, 1997

[51] Int. Cl.[6] ..... C25D 1/02

[52] U.S. Cl. ..... 205/73; 205/72; 205/50

[58] Field of Search ..... 205/70, 72, 73, 205/170, 194, 196, 50

[56] References Cited

U.S. PATENT DOCUMENTS

| | | | |
|---|---|---|---|
| 3,601,178 | 8/1971 | Marticorena | 164/45 |
| 3,973,716 | 8/1976 | Flamand | 228/118 |
| 4,343,684 | 8/1982 | Lechtzin | 204/4 |
| 4,446,102 | 5/1984 | Bales | 420/507 |
| 4,464,231 | 8/1984 | Little | 204/9 |
| 4,681,664 | 7/1987 | Eberle et al. | 204/9 |
| 4,710,276 | 12/1987 | Kull | 204/9 |
| 5,172,568 | 12/1992 | Senanayake | 63/2 |
| 5,356,528 | 10/1994 | Fukuda et al. | 205/155 |
| 5,390,510 | 2/1995 | Trio-Cloonan | 63/1.1 |
| 5,393,405 | 2/1995 | Iacono et al. | 205/72 |
| 5,529,680 | 6/1996 | Kitada et al. | 205/67 |
| 5,667,663 | 9/1997 | Rickerby et al. | 205/170 |

FOREIGN PATENT DOCUMENTS

| | | |
|---|---|---|
| 0157229 | 12/1979 | Japan . |
| 0092192 | 6/1982 | Japan . |
| 0028335 | 7/1994 | Japan . |
| 0659927 | 10/1951 | United Kingdom . |
| 2167444 | 5/1996 | United Kingdom . |

OTHER PUBLICATIONS

"*Electroforming in Gold Jewellery Production*" by Dr. Franz Simon, 12 pages, as appeared in Interfinish 92 (no month).

"*Forming a Niche*" by Clark Heideger as appeared in AJM, Jan. 1996, pp. 40–45.

"*Electroforming Technology—Economical Alternatives to Traditional Manufacturing Methods of High Quality Karat Jewelry*" by Alan Day and Michael Larochelle as presented at Expo Providence, Apr. 10, 1995, pp. 1–15.

Day and Larochelle, "Economical Alternatives to Traditional Manufacturing Methods for High Quality Karat Jewelry", pp. 1–15, Expo Providence, Apr. 1995.

Dr. Franz Simon, "Electroforming in Gold Jewelry Production"; Interfinish 92, 1992.

O.J. Klingenmaier, "Hard Iron Plating of Aluminum Pistons"; 6th Annual Tech. Conf. of Am. Electroplaters' Soc., Jun. 1974.

Clark Heideger, "Forming a Niche" AJM, Jan. 1996.

*Primary Examiner*—Arun S. Phasge
*Assistant Examiner*—Erica Smith-Hicks
*Attorney, Agent, or Firm*—Ohlandt, Greeley, Ruggiero & Perle

[57] ABSTRACT

A method of forming a hollow metallic article, comprising the following steps: (a) applying a layer of base metal to a fusible alloy mandrel; (b) applying a layer of precious metal to the layer of base metal; (c) applying a third layer of a non-metallic protective coating to the layer of precious metal; and (d) melting out the fusible alloy mandrel. Hollow articles formed by this method are also disclosed.

23 Claims, 1 Drawing Sheet

ELECTROFORMED HOLLOW JEWELRY

FIELD OF THE INVENTION

The present invention relates generally to electroformed jewelry and the method of forming such electroformed jewelry. More particularly, the present invention relates to jewelry formed by electroforming layers of precious or non-precious metals about a metal mandrel. The metal mandrel is subsequently melted out to provide a hollow piece of jewelry.

BACKGROUND OF THE INVENTION

Electroforming as a method of creating lightweight, hollow jewelry, as well as other decorative and functional metal articles, is known in the art. Electroforming is a process in which a cast or mandrel is formed in the shape of the desired finished item. One or more thick metal layers is applied by electroplating. Then the mandrel is removed from the plated layer.

The following will describe prior art techniques for making electroformed jewelry and the shortcomings of those techniques. In the prior art, electroformed jewelry is typically composed of precious metals when the electroforming process is complete. In one prior art embodiment, the mandrel is formed of electrically conductive material, such as a white metal fusible alloy or solder. A copper layer is plated as a barrier to the molten white metal and to provide a bright finish. A thick layer of precious metal is then plated onto the mandrel. Typically, a copper protective layer is plated on top of the precious metal electroform to protect the gold or precious metal from splatter during the melt-out process. The mandrel is then melted or dissolved out through unplated apertures in the precious metal layer, leaving a hollow shell of precious metal. If the molten white metal were to contact the gold, unremovable stains and defects would be formed. However, such splattering is virtually unavoidable, even if great care is taken to prevent it. Only by subsequently replating the item can these defects be corrected. Also, the protective copper layer prevents formation of holes and cracks in the finished item caused by contact with high temperature tin. This problem occurs most frequently in items having complex shapes.

Subsequently, the protective copper layers are dissolved by using strong acids that do not affect the precious metal. Spent acids will contain the dissolved heavy metals which require treatment before disposal. Moreover, the precious metal layer must be substantially thick, and hence very expensive, to maintain the integrity of the hollow shell once the mandrel is melted out.

Attempts have been made to form costume jewelry having a much lower precious metal content by the electroforming process on white metal. However, the process used to form precious metal electroforms cannot be used to form costume jewelry. The strong acids used to dissolve the outer protective copper layer would attack the base metal electroform and destroy it.

The alternate prior art methods that have been developed employ wax mandrels instead of the fusible alloy mandrels. The typical method requires a wax mandrel to be formed, which is more complicated than casting a metal mandrel. The mandrel is sprayed with a conductive silver paint, which results in the loss of a substantial amount of silver. Then, the mandrel is laboriously affixed by hand to a plating rack by means of a pin pierced through the silver paint into the wax. The item is then electroplated with copper followed by the precious metal layer.

For electroformed precious metal jewelry, the precious metal layer is thick enough to maintain the integrity of the hollow shell once the core and electroplated copper are removed. In a special prior art method known as the "hollow shell" method, the wax core is removed after copper plating and prior to gold plating in order to prevent the stresses of expanding molten wax from cracking the gold. After wax removal, the hollow copper shell is gold electroformed. In both prior art precious jewelry methods, the copper is removed with strong acids leaving the gold shell. If the wax surface is sufficiently level and bright, and the gold deposit is ductile enough to withstand the expansion of the wax during melting, the copper layer can be omitted for precious jewelry electroforming.

In all cases, the wax mandrel is typically removed using solvents of high volatile organic content, which in turn requires the use of special solvent extraction equipment with the associated safety and environmental requirements. The copper is removed using strong acids, which have the drawbacks previously described.

These methods require skilled casting of the wax mandrel, application of a spray coat of highly conductive paints onto the wax mandrel, and labor intensive, time consuming, costly plating and processing. Such wax mandrels are also more fragile and deformable than the fusible alloy substrates used in precious metal electroforming. Additionally, to plate gold alloys of specific Karatage, computer controlled high speed plating systems must be used to produce finished goods of consistent quality.

Accordingly, a method is needed for making hollow articles of costume jewelry and the like based on a fusible metal alloy. Heretofore, a feasible method has not been disclosed. The prior art methods for making precious hollow jewelry using white metal mandrels involve a complicated procedure generating substantial volumes of toxic waste. The method described herein is environmentally friendlier and simpler for high volume manufacturing.

SUMMARY OF THE INVENTION

Accordingly, it is an object of the present invention to provide a hollow article that is formed by electroforming about a fusible metal alloy.

It is a further object of the present invention to provide an efficient and environmentally safer method for electroforming a hollow article.

Accordingly, the present invention provides a method of forming a hollow metallic article, comprising the steps of:

(a) applying a layer of base metal to a fusible alloy mandrel;

(b) applying a layer of precious metal to the base metal layer;

(c) applying a third layer of a non-metallic protective coating to the precious metal layer; and (d) melting out the fusible alloy mandrel.

Hollow articles formed by this method are also disclosed.

DESCRIPTION OF THE PREFERRED EMBODIMENTS

Figure 1:
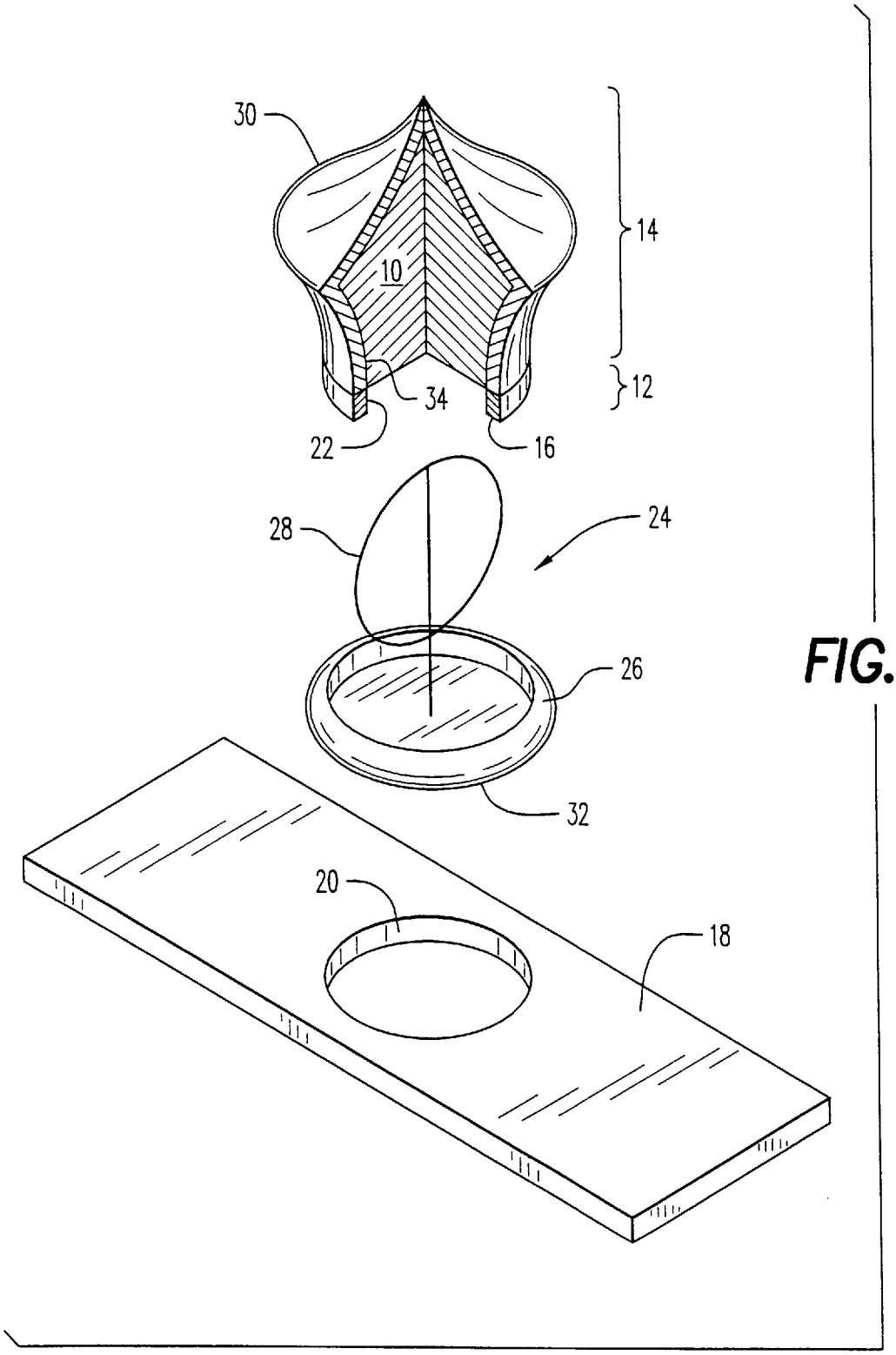
FIG. 1 shows the electroformed jewelry article and end cap portion before removal of the mandrel.

Known processes for the manufacture of hollow jewelry require unfriendly manufacturing processes and have high material, operation and labor costs. The present invention simplifies the process by using techniques that are compatible with conventional procedures for manufacturing costume jewelry.

Accordingly, the present invention provides a method of forming a hollow metallic article, comprising the steps of:

(a) applying a layer of base metal to a fusible alloy mandrel;

(b) applying a layer of precious metal to the base metal layer;

(c) applying a third layer of a non-metallic protective coating to the precious metal layer; and (d) melting out the fusible alloy mandrel.

This method produces hollow metallic articles of sufficient strength and integrity for use as, for example, earrings or other jewelry components.

The mandrel is preferably formed of white metal. The white metal should give a casting of low porosity, acceptable shrinkage and good surface finish. Preferred alloys for this white metal include zinc alloys, tin alloys, and bismuth alloys. Most preferred are tin alloys containing, in weight percent (throughout), about 88 percent to about 95 percent tin, up to about 5 percent antimony (optimally 1 percent to 4 percent), and up to about 9 percent lead (optimally 4 percent to 9 percent). Also most preferred are the low melting point alloys containing about 42 percent tin and about 58 percent bismuth, or the alloy containing about 15 to about 25 percent tin (optimally about 15 to about 20 percent), about 22 to about 40 percent (optimally about 31 to about 35 percent) lead, and about 32 to about 56 percent (optimally about 45 to about 51 percent) bismuth.

The most preferred, detailed method for forming the hollow object may include the following steps:

(a) casting white metal in rubber or silicone rubber molds;

(b) masking off, with such materials as stop off resin or wax, at least one and preferably two spots where no plating will occur, to act as sites from which the molten metal will flow;

(c) plating an adhesion layer such as alkaline or cyanide copper;

(d) plating a molten tin barrier layer (of such materials as iron, iron alloy, chromium, chromium alloy, refractory metals or alloys or other materials forming a layer that the molten core will not dissolve), to prevent the molten tin alloy from dissolving the electroform;

(e) plating the electroform in copper, nickel, silver or other desirable strengthening metals or alloys that can be plated in a continuous plate;

(f) plating an oxidation resistant and diffusion barrier layer, such as nickel or palladium;

(g) plating the hollow item with conventional costume jewelry decorative coatings, such as, for example, gold, silver, palladium, platinum or rhodium;

(h) coating the item with a thermally stable, nonmetallic, removable protective coating, such as sodium silicate (water glass), silicone polymers (conformal coatings), silicon oxide or other transparent metal oxides, which can be applied from an aqueous state (such as tin oxide sol);

(i) melting out the white metal of the mandrel;

(j) optionally dissolving the residual white metal chemically;

(k) removing the protective coating, if aesthetically necessary, by conventional methods;

(l) optionally, removing the metal layers formed during steps (c) and (d); and (m) cleaning the finished item.

Step (a) may optionally include the casting of a pin or a post into the white metal. This provides a hanger for simple racking of the piece during electroforming. The pin or post can be removed after electroforming to provide a drainage hole for the molten metal, or can be used as a component of the finished jewelry item.

Steps (c) and (d), and optionally (e) and (f), constitute a base metal layer, most preferably about 50 to about 10,000 microinches thick (about 1.25 to about 250 micrometers). The molten tin barrier of step (d) is new in the art. Most commonly plated metals dissolve in molten tin. These metals include copper, nickel, silver, gold, palladium, cobalt and zinc. A molten tin barrier can be omitted if a sufficiently thick copper layer is plated so that even if some copper is dissolved in the molten tin, the overall structure of the shell is not affected. However, if the shell is not thick enough, tin will go through to the surface, causing stains that would require replating. Thus, careful monitoring and timing is required when the molten tin barrier is not used. Also, the solder stripper, if used to remove residual white metal from the mandrel, would cause holes in the shell where the tin had penetrated to the surface.

There are a few metals the tin does not dissolve. These include iron and the refractory metals. Except for chromium, the refractory metals cannot be electroplated as pure metals, only as alloys. Therefore, a thin layer of one of these alloys would act as a barrier to the molten tin, preventing the copper, gold or silver from being attacked, and permitting a thinner shell. Yet iron plating is rarely done, and no iron baths are commercially available from plating vendors. Chromium plating is known, but only as an outer layer, not as an inner layer. This is also true of the new refractory metal alloys, which are used as chromium plating substitutes.

The adhesion layer of step (c) is coated to a preferred thickness of about 50 to about 400 microinches (about 1.25 to about 10 micrometers), and most preferably to a thickness of about 50 ; to about 100 microinches (about 1.25 to about 2.5 micrometers). The molten tin barrier layer of step (d) is preferably about 50 to about 1000 microinches (about 1.25 to about 25 micrometers) thick, and most preferably about 100 to about 200 microinches (about 2.5 to about 5 micrometers) thick. The strengthening metal layer of step (e) is of a preferred thickness of about 3000 to about 10,000 microinches (about 75 to about 250 micrometers) and most preferably of a thickness of about 5000 microinches (about 125 micrometers, or less if an iron layer is used).

The layer of step (f) is plated to a preferred thickness of about 3 to about 800 microinches (about 0.075 to about 20 micrometers), more preferably about 50 to about 800 microinches or greater (about 1.25 to about 20 micrometers), and most preferably about 300 to about 400 microinches (about 7.5 to about 10 micrometers) if nickel is used; and to a preferred thickness of about 3 to about 25 microinches (about 0.075 to about 0.625 micrometers) if palladium is used. The decorative coating of step (g) is plated to a preferred thickness of about 1 to about 10,000 microinches thick (about 0.025 to about 250 micrometers), more preferably about 2 to about 150 microinches (about 0.05 to about 3.75 micrometers), or about 1 to about 20 microinches (about 0.025 to about 0.5 micrometers) if platinum or rhodium are used.

The preferred coatings of step (h) are optically clear, thermally stable and aesthetically invisible or easily removed after melting out the core. These coatings are preferably thermally stable to the temperature range at which the white metal alloy mandrel melts, i.e., about 250° C. for 95% tin alloys with antimony and lead. They are coated to a preferred thickness of about 100 to about 4000 microinches (about 2.5 to about 100 micrometers). The melting process of step (i) is preferably performed in an oven. The preferred acid blend of step (j) is a solder stripper that attacks the base metal very slowly or not at all, yet attacks the tin alloy rapidly. For example, a specially formulated acid blend which dissolves tin alloys but not copper, i.e., an environmentally friendly solder stripper, is preferred for use in this step. These solder strippers are available from a number of vendors of plating chemicals. Their compositions vary and include strippers containing hydrogen peroxide and fluorides, nitric acid and ferric nitrate, or nitric acid with methane sulfonic acid and thiourea. Each formulation has stabilizers to slow or stop attack on copper. Heretofore, solder strippers are not known for use in jewelry manufacturing. They are used primarily in circuit board manufacturing, to remove tin or tin/lead plating from copper plated areas that are then plated with nickel and gold.

What differentiates the acids used to dissolve the white metal in this invention from strong acids of the prior art is that the copper is not removed with these solder strippers. In comparison, the strong acids of the prior art will dissolve all metals except gold. The quantity of heavy metals present in the spent acids of the prior art would be significantly greater than those generated by the method of the present invention, because the prior art strong acids would attack copper as well as the white metal residues.

The protective coating can be removed according to step (k). For example, a coating of water glass can be dissolved away in hot water, and a conformal coating of silicone polymer can be removed by mild mass finishing with soft media such as wood chips, or with a silicone-removing solvent.

This method allows the production of bold lightweight costume jewelry. Furthermore, the production is achieved at reduced cost and with less processing than prior art methods. Still further, pieces of substantial size can be formed that are nonetheless not heavy or uncomfortable to wear. In addition, the method of the present invention accommodates loose rack plating, where the pieces are merely dangling loose on the plating rack. This contrasts with the complex and expensive process of the prior art that requires the pieces to be positively mounted or affixed to the rack before plating. Moreover, by completing all electroplating, including the decorative precious metal layer, before the white metal is melted out, the difficulties associated with coating a hollow object, such as floating, rinsing, and carry over of plating solutions from one process to another, are avoided.

In an alternate preferred embodiment, after the oxidation resistant layer is plated, the white metal mandrel is melted out, the residual white metal dissolved, and the hollow item plated according to conventional costume jewelry procedures.

While the electroforming method of the present invention is preferred for creating costume jewelry, karat gold and silver can also be electroformed in this fashion, preferably by use of a barrier coating such as iron, as set forth in step (d) above. Iron, which is suitable because it can be used in a very thin coating, permits the inner protective layers to be kept to a minimum content, thus not affecting the percentage of total precious metal. If the protective coatings are removed, trade requirements for the marketing of karat gold can be met. If, as in such a case, removal of the excess white metal is desired, one of the solder strippers discussed above could be used.

In a further preferred embodiment, as shown in FIG. 1, the mandrel 10 is made with a collar 12 extending, for example, about one-quarter inch above the main body 14 of the design element of the mandrel 10 and about one-quarter inch in diameter. Stop off resin is coated on the top 16 of the collar 12 to prevent plating in this area. The mandrel 10 is finished and plated with a minimum of about five one-thousandths of an inch (5,000 microinches, or about 125 micrometers) of copper, about 300 microinches (about 7.5 micrometers) of nickel or about 10 microinches (about 0.25 micrometers) of palladium, and a finish gold plate.

The gold plate is protected with the coating of the present invention to prevent tarnish and staining during melt out. The plated mandrel 10 is placed on a carbon board 18 modified with a hole 20 of the proper size to hold the mandrel 10 such that the collar 12 is facing down. The fusible metal core is melted out through an opening 22 in the collar 12 and the protective coating is removed.

A special cap 24 with bent ends 26 and a spring tension wire 28 that fits inside the hollow item 30 is attached. The cap 24 will be completely plated and have components, such as an ear wire for earrings or a post for a pin (not shown), for attachment and finishing the jewelry item, soldered to the side 32 facing out of the hollow item 30 opposite the spring tension wire 28. When the spring tension wire 28 is inserted in the opening 22 through the collar 12, the wire 28 releases and becomes fixtured to the inside wall 34 of the hollow item 30, mechanically holding the cap 24 in place. The end cap 24 is then either crimped to the collar 12 or otherwise made to fit tightly, by adhering it, screwing it down, or by another method. This produces an essentially complete jewelry design element such as an earring. An advantage of this method is that only one hole is needed for melting out the white metal, and this hole is mechanically sealed with a complete assembly. No soldering or other post-plating finishing step is required. Additionally, components such as earring posts can be cast into the electroform, if a sufficient base or platform is provided for attachment to the electroform.

Various modifications may be made as will be apparent to those skilled in the art. Thus, it will be obvious to one of ordinary skill in the art that the foregoing description and drawings are merely illustrative of certain preferred embodiments of the present invention, and that various obvious modifications can be made to these embodiments in accordance with the spirit and scope of the appended claims.

What is claimed is:

1. A method of electroforming a hollow metallic article, comprising the following steps:

(a) applying at least one layer of base metal to a fusible alloy mandrel;

(b) applying at least one layer of precious metal to said layer of base metal;

(c) applying a layer of a non-metallic protective coating to said layer of precious metal; and (d) melting out said fusible alloy mandrel.

2. The method of claim 1, wherein said base metal is selected from the group consisting of a high tin alloy, a zinc alloy and a combination thereof.

3. The method of claim 2, wherein said base metal includes about 88 to about 95 percent by weight of tin, up to about 9 percent by weight of lead, and up to about 9 percent by weight of bismuth.

4. The method of claim 3, wherein said base metal further includes about 1 to about 5 percent by weight of antinmony, up to about 2 percent by weight of copper, and up to about 2 percent by weight of silver.

5. The method of claim 1, wherein said base metal is includes tin, lead and bismuth.

6. The method of claim 1, wherein said non-metallic protective coating is inorganic.

7. The method of claim 1, wherein said non-metallic protective coating is thermally stable at temperatures of about 250° C.

8. The method of claim 1, further comprising the step of casting a mount into said fusible alloy mandrel before plating and melting out said fusible alloy mandrel.

9. The method of claim 1, further comprising the step of attaching a separate component to said article, wherein said component is affixed to a spring tension wire, and said spring tension wire is inserted into and released within said article.

10. The method of claim 9, wherein said spring tension wire is inserted into an aperture in said article through which said fusible alloy mandrel was melted out.

11. The method of claim 9, wherein an end cap is situated intermediate said component and said spring tension wire, said end cap being seated on an exterior of said article, and said end cap is attached to said article by the further step selected from the group consisting of crimping, screwing, bonding, or a combination thereof.

12. The method of claim 1, further comprising:

dissolving a residue of said fusible alloy mandrel by a selective acid, wherein said selective acid is inhibited against attacking said hollow jewelry item.

13. The method of claim 12, wherein said selective acid is a solder stripper.

14. A method of electroforming a hollow metallic article, comprising the steps of:

(a) applying at least one layer of base metal to a fusible alloy mandrel;

(b) applying at least one layer of precious metal to said layer of base metal;

(c) applying at least one layer of a non-metallic protective coating to said layer of precious metal;

(d) melting out said fusible alloy mandrel; and (e) removing said non-metallic protective coating from said article after said fusible alloy mandrel is melted out.

15. A method of electroforming a hollow metallic article, comprising the steps of:

(a) applying at least one layer of base metal to a fusible alloy mandrel;

(b) applying at least one layer of precious metal to said layer of base metal;

(c) applying at least one layer of a non-metallic protective coating to said layer of precious metal; and (d) melting out said fusible alloy mandrel, wherein said at least one layer of base metal includes a molten tin barrier layer.

16. The method of claim 15, wherein said molten tin barrier layer has a thickness of about 50 to about 1000 microinches.

17. A method of electroforming a hollow metallic article, comprising the steps of:

(a) applying at least one layer of base metal to a fusible alloy mandrel;

(b) applying at least one layer of precious metal to said layer of base metal;

(c) applying at least one layer of a non-metallic protective coating to said layer of precious metal; and (d) melting out said fusible alloy mandrel wherein said base metal includes about 15 to about 25 percent by weight of tin, about 22 to about 40 percent by weight of lead, and about 32 to about 56 percent by weight of bismuth.

18. A method of electroforming a hollow metallic article, comprising the steps of:

(a) applying at least one layer of base metal to a fusible alloy mandrel;

(b) applying at least one layer of precious metal to said layer of base metal;

(c) applying at least one layer of a non-metallic protective coating to said layer of precious metal, wherein said non-metallic protective coating is inorganic, and wherein said non-metallic protective coating includes a substance selected from the group consisting of sodium silicate, silicone polymers, silicon oxide, transparent metal oxides and mixtures thereof; and (d) melting out said fusible alloy mandrel.

19. The method of claim 18, wherein said non-metallic protective coating includes sodium silicate, and said sodium silicate is removed from said article by dissolution in hot water.

20. The method of claim 18, wherein said non-metallic protective coating includes a silicone polymer, and said silicone polymer is removed from said article by mild mass finishing with soft media.

21. The method of claim 18, wherein said non-metallic protective coating includes a silicone polymer, and said silicone polymer is removed from said article with a silicone-removing solvent.

22. A method of electroforming a hollow metallic article, comprising the steps of:

(a) applying at least one layer of base metal to a fusible alloy mandrel;

(b) plating a molten metal barrier layer;

(c) applying at least one layer of precious metal to said barrier layer;

(d) applying a layer of a non-metallic protective coating to said layer of precious metal; and (e) melting out said fusible alloy mandrel.

23. The method of claim 22, wherein said molten metal barrier layer is selected from the group consisting of iron, iron alloy, chromium, chromium alloy, refractory metals or alloys.

* * * * *